United States Patent [19]

Ferris et al.

[11] 4,244,568

[45] Jan. 13, 1981

[54] GAME APPARATUS

[75] Inventors: Michael J. Ferris, Chicago; Burton C. Meyer, Downers Grove, both of Ill.

[73] Assignee: Marvin Glass & Associates, Chicago, Ill.

[21] Appl. No.: 10,832

[22] Filed: Feb. 9, 1979

[51] Int. Cl.[3] ..... A63F 9/00

[52] U.S. Cl. ..... 273/1 R; 46/123

[58] Field of Search ..... 273/1 R, 1 E, 1 M, 95 A; 46/122, 123, 124, 141, 4

[56] References Cited

U.S. PATENT DOCUMENTS

| | | | |
|---|---|---|---|
| 3,649,009 | 3/1972 | Breslow | 273/1 R |
| 3,688,435 | 9/1972 | Sapkus et al. | 46/123 X |
| 3,754,759 | 8/1973 | Breslow et al. | 273/1 R |
| 4,050,183 | 9/1977 | Watanabe | 46/4 |
| 4,119,312 | 10/1978 | Todokoro | 273/1 R |

*Primary Examiner*—Paul E. Shapiro

*Attorney, Agent, or Firm*—Mason, Kolehmainen, Rathburn & Wyss

[57] ABSTRACT

A game apparatus includes a cross shaped base having a plurality of radially directed legs and an operable player actuated capturing element at the end of each leg, each of which is designed to appear as a frog. A rotatable arm is mounted at the center of the base and includes, at its free end, a connector for releasably mounting one of a plurality of playing pieces, which are designed to appear as bees. A timing gear arrangement on the underside of the base rotates the arm as a crank arm is manually rotated by one of the players of the game. Each of the player operated capturing elements includes a hollow body portion and a pivoted top between which the playing pieces move, one at a time, as the arm is manually rotated. The other players of the game attempt to capture a playing piece by knocking the piece from the end of the rotatable arm into the body by pivoting the cover downwardly. In addition, a chance device, including a spinner and numerical indicator is concentrically mounted on the center of the base.

10 Claims, 5 Drawing Figures

GAME APPARATUS

BACKGROUND OF THE INVENTION

1. Field of the Invention

The present invention is directed toward a new and improved game apparatus, and in particular, to a game which provides a structure permitting the players of the game to attempt to acquire a predetermined number of playing pieces.

2. Brief Description of the Prior Art

A wide variety of games have been developed wherein the object of the game is for each of the players to attempt to capture a predetermined number of playing pieces during the play of the game. Typical board games such as checkers or wealth-type acquisition games have provided much joy and entertainment for players of all ages. Certain other games have been devised which provide a mechanical structure, operated by the players of the game, in an attempt to perform a task, sometimes chosen by chance. In the game contemplated by the present invention, each player sequentially attempts to move a playing piece along a path of travel in which it may be captured by the other players of the game. A successful passage along the path enables a particular operator to acquire one of the playing pieces. Alternatively, an unsuccessful traversing of the path results in one of the other players capturing a playing piece.

SUMMARY OF THE INVENTION

It is an object of the present invention to provide a new and improved game apparatus of the character described above. Another object of the present invention is to provide a new and improved game apparatus suitable for young children based on a familiar theme in which frogs attempt to capture insects, such as bees or flies. In accordance with the above and other objects, the present invention provides a game apparatus including a base having a plurality of radially directed legs and an operable player actuated capturing element at the end of each leg, each of which is designed to appear as a frog. A rotatable arm is mounted at the center of the base and includes, at its free end, a connector for releasably mounting one of a plurality of playing pieces, which are designed to appear as bees. A timing gear arrangement on the underside of the base rotates the arm as a crank arm is manually rotated by one of the players of the game. Each of the player operated capturing elements includes a hollow body portion and a pivoted top between which the playing pieces move, one at a time, as the arm is manually rotated. The other players of the game attempt to capture a playing piece by knocking the piece from the end of the rotatable arm into the body by pivoting the cover downwardly. In addition, a chance device, including a spinner and numerical indicating means is concentrically mounted on the center of the base.

DESCRIPTION OF THE PREFERRED EMBODIMENT

Figure 1:
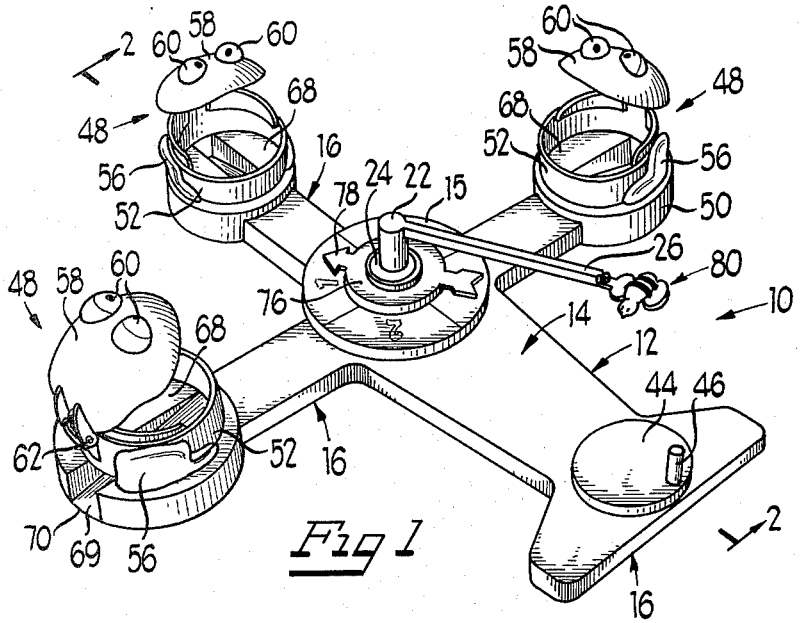
FIG. 1 is a perspective view of a game apparatus constructed in accordance with the features of the present invention.
Figure 2:
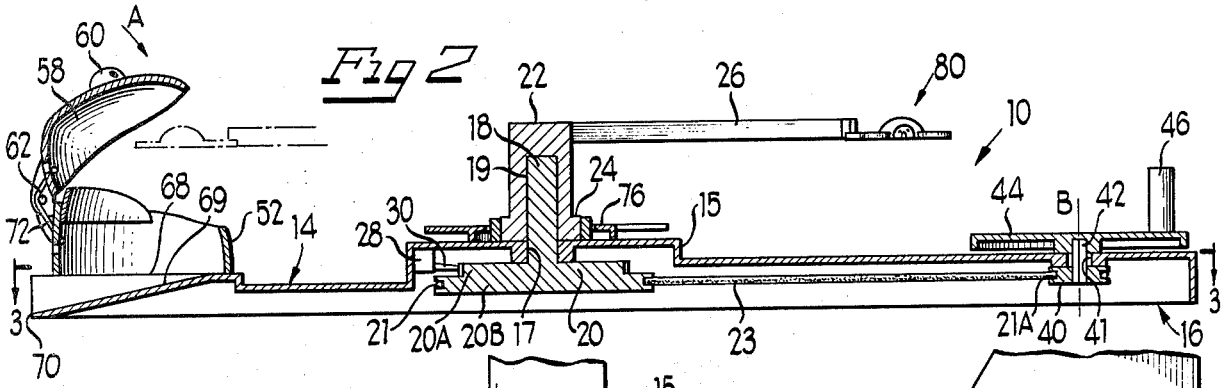
FIG. 2 is a vertical section of the game apparatus, on an enlarged scale, taken generally along lines 2—2 of FIG. 1.
Figure 3:
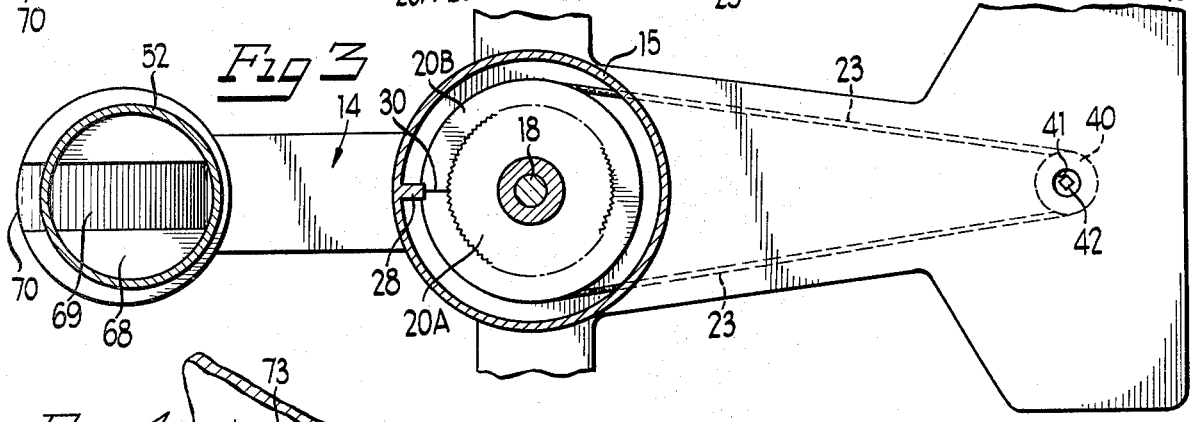
FIG. 3 is a horizontal section taken generally along line 3—3 of FIG. 2.
Figure 4:
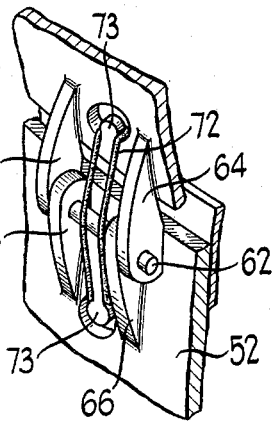
FIG. 4 is a fragmented, perspective view, on an enlarged scale, of a hinge element and biasing means utilized in the present invention.

Referring particularly to the drawings, there is illustrated a new and improved game apparatus constructed in accordance with the features of the present invention and referred to generally by the reference numeral 10. The game apparatus includes a cross shaped base structure 12 having an irregularly shaped flat or planar horizontal surface 14 formed with a depending peripheral skirt 16 around the outer edge of the horizontal surface to support the toy on a floor or other suitable playing surface as shown in FIGS. 1 and 2. Preferably, the base structure is formed of an integrally molded plastic material and includes a center, raised cylindrical structure designated by the numeral 15. An aperture 17 in the center of the raised structure 15 provides a journal for an upwardly extending shaft 18 mounted therein. A timing gear 20 is secured to the shaft 18 below the surface of the structure 15 for conjoint rotation with the shaft 18. The timing gear 20 is retained in the position as shown in FIG. 2 by the insertion and press fitting of the shaft into a central aperture of an upper rotatable hub 22. The hub 22 includes a lower, enlarged annular flange 24 for added rigidity and to provide a bearing surface for a chance device as described in detail hereinafter. A radially extending arm 26 is secured to the top of the hub and extends outwardly in a direction normal to the axis of rotation of the hub. The radially extending arm will thereby rotate conjointly with the timing gear 20 within the journal 17. A sounding device is formed by a saw tooth gear **20*a* formed integrally on the upper surface of the timing gear 20 as shown in FIGS. 2 and 3. A leaf spring or wafer element 30 is secured to the edge of the structure 15 so as to engage the teeth of the gear 20*a*, as best seen in FIG. 3**, thereby producing an audible signal whenever the timing gear is rotated.

The timing gear 20 includes a channel or groove 21 for receiving a timing belt, generally designated 23. The timing belt, as shown in phantom in FIG. 3, is wrapped about a groove **21*a* providing in a smaller drive gear 40. The drive gear 40 may be formed integrally with an upwardly extending square shaft 42 through an aperture 41 in one of the radially extending legs as shown. Preferably, the shaft 42 is press fit or secured by other means within an appropriate aperture formed in a circular crank disc 44 which includes an upstanding concentric handle 46 for use in rotation of the crank. Manual rotation of the crank disc 44 through the timing belt will rotate the arm 26** about a generally central axis.

In accordance with the present invention, the game apparatus includes on each of the other legs an operable player actuated playing piece capturing element generally designated 48. Each of the playing piece capturing elements includes a generally cylindrical, hollow base portion 50 connected to the end point of the respective leg. Each element includes a cylindrical body portion 52 and a pair of irregularly shaped integral feet portions 56 representing the feet of a frog-like creature. A hemispherically shaped cover or head 58 is pivotally mounted on each of the elements to resemble the head of a frog and include a pair of frog eyes 60 for realism, as shown. Hinge means is provided to pivotally mount the covers 58 on the cylindrical portions 52 and includes a biasing means to support the covers in a generally open position as shown in FIGS. 1 and 2. The hinge means includes a pivot pin 62 rotatably secured between a pair of downwardly directed flanges 64 on the covers and a similar pair of aligned, upwardly directed flanges 66 on the cylindrical surface, generally on the outer periphery relative to the center of the base. Each cylindrical body includes a bottom surface of floor 68 as shown in FIGS. 1 and 3. A cutout in the floor 68, generally in the center thereof, provides a canted surface or slide 69 which exits outwardly through a radially directed aperture 70.

The tops of the capturing elements 58 are biased to a normally open position by a resilient means such as a rubberband 72 connected between eyelets 73 located in the tops 58 and cylindrical walls 52 as shown. The biasing means is stretched over the outside of the pivot pin 62 thereby applying a sufficient tension to hold the covers 58 in their open condition as shown in FIG. 1. During the play of the game, the covers 58 can be closed by a downward pressure, generally in the direction of arrow A as shown in FIG. 2 applied by the hand of the player.

The chance means, as described above, includes a pointer or spinner element 76 mounted for rotation on the exterior surface of the flange 24 on the hub 22. The spinner includes an arrow head end 78 which is utilized for reading the chance device. The raised section 15 is divided into quadrants by suitable means, such as the indicia shown in FIG. 1 and the quadrants are numbered 1, 2, 3 and "free bee".

Figure 5:
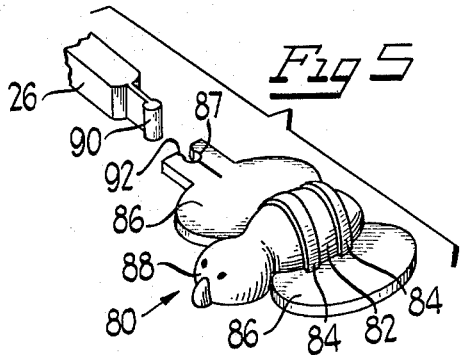
FIG. 5 is a partially fragmented, exploded perspective view, on an enlarged scale, of a playing piece prior to mounting on the end of the rotatable arm.

A plurality of playing pieces, generally designated 80 (FIG. 5) are provided for the play of the game. Each of the playing pieces 80 is in the form and shape of a flying insect such as the bee shoun in FIG. 5. The bee includes a central body portion 82, a pair of wings 86, if desired, a pair of alternately colored stripes 84, and a head portion 88. One of the wings 86 includes means for connecting the playing piece 80 on the end of the rotating arm 26. In particular, the connection means on the end of the arm 26 includes a flat flange which terminates in a generally vertical cylindrical knob or end. The playing pieces each include a connector, generally extending outwardly from one of the wings 86 in the form of a slotted complementarily shaped aperture 87 which engages the end 90. A pair of chamfered surfaces 92 facilitate the "snapping " connection of the playing pieces on the end of the arm 26.

Thus, during the play of the game, the players sequentially operate the crank 44 to cause one of the playing pieces 80 to travel in a circular path which intersects the pivotal movement of the heads of the playing piece capturing elements 48, as shown generally in phantom in FIG. 2. As the "bee" moves past a player's "frog", the player attempts to capture the bee by quickly manually closing the cover 58 to knock the bee from the end of the arm 26 and into the cylindrical portion 52, from which it is delivered down the slide 69 to the player. In one scheme of play of the game, seventeen "bee" playing pieces are provided for use by the players. The bees are acquired, one at a time, from a "bank" and placed by a player operating the crank on the end of the arm 26. The chance device is used to indicate how many rotations of the arm 26 must be attempted by the player operating the crank. If a player completes all of the required rotations, 1, 2 or 3, he acquires the playing piece which he placed on the end of the arm, and the base is rotated so that the next player operates the crank device. If, during the travel of a playing piece 80 in its circular route, one of the players captures the playing piece by timely actuation of his playing piece capturing element, he is awarded that playing piece, and again, the turn passes to the next player. One of the quadrants of the chance device is designated "free bee" and if the chance device indicates this quadrant, that player is only required to rotate the arm 26 through one revolution in order to acquire that playing piece, and in addition, he may designate one of the other players, at his discretion, who is not permitted during that turn to attempt to capture the playing piece. In one scheme of play, seventeen playing pieces are provided and the first player to acquire five of the playing pieces is declared the winner of the game. Obviously, many other uses of the present invention can be devised without departing from the scope and spirit of the present invention. In addition, many minor modifications to the structure will obviously provide different advantages and possibly plays of the game. Therefore, the foregoing detailed description has been given for clearness of understanding only and no unnecessary limitations should be understood therefrom as some modifications will be obvious to those skilled in the art.

We claim:

1. A game apparatus, comprising:

a base having a portion thereof for supporting the apparatus on a suitable supporting surface;

at least one playing piece;

means for moving said playing piece about a path generally above said base, said piece being releasably attached to said moving means; and at least one playing piece capturing member having a pivoted portion secured to the base for capturing a moving playing piece by removing said piece from said moving means and retaining said playing piece, simulating consumption of a prey by a predator.

2. The game apparatus of claim 1 wherein said means for rotating a playing piece comprises a rotating arm mounted for rotation generally about the center of the base.

3. The game apparatus of claim 2 wherein said rotating means further includes a timing gear mechanism including a manually operable crank remote from said rotating arm for driving the arm in its path of travel.

4. The game apparatus of claim 2 wherein said playing pieces are generally in the shape of flying insects and said playing piece capturing elements are generally in the shape of a frog.

5. The game apparatus of claim 2 including chance means, operable by the players of the game, to determine the degree of travel of said rotating means.

6. The game apparatus of claim 5 including sound generating means for providing an audible signal when said playing pieces are rotated by said rotating means, said sound generating means providing a signal simulating the sound of a flying insect.

7. A game apparatus for two or more players, comprising:

a generally cross shaped base having a plurality of generally elongated radially extending portions;

a plurality of playing pieces;

means for rotating the playing pieces, one at a time, about a generally circular path above the extending portions of said base, said pieces being releasably attached to said moving means; and an operable, player actuated playing piece capturing element mounted on a plurality of base extensions, generally in the path of travel of said playing piece, said playing piece capturing elements including means for capturing one of said playing pieces by removing one of said pieces from said moving means and retaining said playing piece, simulating consumption of a prey by a predator.

8. The game apparatus of claim 7 wherein said means for rotating comprises a generally horizontal arm rotatably mounted at the center of the base for moving a playing piece in a circular path adjacent the capturing elements.

9. The game apparatus of claim 8 wherein each of the capturing elements includes a manually actuatable, pivotal cover portion which may be moved by the player of the game in an attempt to capture a playing piece by knocking the playing piece off of the end of the rotating arm.

10. The game apparatus of claim 9 wherein said playing pieces are in the form and shape of flying insects such as bees or the like, and the playing piece capturing elements are in the form and shape of insect eating creatures such as frogs or the like.

* * * * *